US011430588B2

(12) United States Patent
Kuse et al.

(10) Patent No.: US 11,430,588 B2
(45) Date of Patent: Aug. 30, 2022

(54) SOFT MAGNETIC FLAKY POWDER

(71) Applicant: Sanyo Special Steel Co., Ltd., Himeji (JP)

(72) Inventors: Tetsuji Kuse, Himeji (JP); Koudai Miura, Himeji (JP); Toshiyuki Sawada, Himeji (JP)

(73) Assignee: Sanyo Special Steel Co., Ltd., Himeji (JP)

( * ) Notice: Subject to any disclaimer, the term of this patent is extended or adjusted under 35 U.S.C. 154(b) by 733 days.

(21) Appl. No.: 16/470,689

(22) PCT Filed: Dec. 18, 2017

(86) PCT No.: PCT/JP2017/045357
§ 371 (c)(1),
(2) Date: Jun. 18, 2019

(87) PCT Pub. No.: WO2018/117036
PCT Pub. Date: Jun. 28, 2018

(65) Prior Publication Data

US 2019/0326040 A1 Oct. 24, 2019

(30) Foreign Application Priority Data

Dec. 19, 2016 (JP) ..... JP2016-245056

(51) Int. Cl.

| | |
|---|---|
| ***H01F 1/147*** | (2006.01) |
| ***B22F 1/02*** | (2006.01) |
| ***C22C 38/06*** | (2006.01) |
| ***C22C 38/02*** | (2006.01) |
| ***B22F 3/24*** | (2006.01) |
| ***B22F 1/16*** | (2022.01) |

(52) U.S. Cl.
CPC ..... *H01F 1/14791* (2013.01); *B22F 1/16* (2022.01); *B22F 3/24* (2013.01); *C22C 38/02* (2013.01); *C22C 38/06* (2013.01); *H01F 1/14733* (2013.01); *B22F 2003/248* (2013.01); *B22F 2201/11* (2013.01); *B22F 2201/20* (2013.01); *B22F 2301/35* (2013.01); *B22F 2304/10* (2013.01); *B22F 2998/10* (2013.01)

(58) Field of Classification Search
None
See application file for complete search history.

(56) References Cited

U.S. PATENT DOCUMENTS

| | | | |
|---|---|---|---|
| 2009/0267017 | A1 | 10/2009 | Matsukawa et al. |
| 2010/0001226 | A1 | 1/2010 | Aramaki et al. |
| 2016/0055947 | A1 | 2/2016 | Pagano et al. |
| 2016/0247612 | A1 | 8/2016 | Ebe et al. |
| 2017/0301442 | A1 | 10/2017 | Maezawa et al. |

FOREIGN PATENT DOCUMENTS

| | | | |
|---|---|---|---|
| CN | 101536121 | A | 9/2009 |
| CN | 105188991 | A | 12/2015 |
| CN | 105593952 | A | 5/2016 |
| JP | 200784839 | A | 4/2007 |
| JP | 200863650 | A | 3/2008 |
| JP | 2008135724 | A | 6/2008 |
| JP | 4636113 | B2 | 12/2010 |
| JP | 201122661 | A | 2/2011 |
| JP | 201161119 | A | 3/2011 |
| JP | 2014225548 | A | 12/2014 |
| JP | 201672577 | A | 5/2016 |
| JP | 2016519430 | A | 6/2016 |
| WO | 2014154737 | A1 | 10/2014 |
| WO | 2014185443 | A1 | 11/2014 |
| WO | 2016052498 | A1 | 4/2016 |

*Primary Examiner* — Anthony M Liang
(74) *Attorney, Agent, or Firm* — The Webb Law Firm

(57) ABSTRACT

In order to provide a soft magnetic flaky powder having high electrical resistance and high corrosion resistance, and a magnetic sheet including the same, the present invention provides a soft magnetic flaky powder, including a plurality of soft magnetic flaky particles. Each of the plurality of soft magnetic flaky particles contains an Fe-based alloy flaky particle and a coating layer formed on a surface of the Fe-based alloy flaky particle. The coating layer contains one or two or more components selected from chromic acid and a hydrate thereof, and a metal salt of an inorganic acid and a hydrate thereof. The inorganic acid is selected from sulfuric acid, nitric acid, chromic acid, phosphoric acid, hydrofluoric acid and acetic acid. The metal salt is selected from a Na salt, an Al salt, a Ti salt, a Cr salt, a Ni salt, a Ga salt and a Zr salt. The coating layer has a thickness of 10 nm or more.

19 Claims, No Drawings

SOFT MAGNETIC FLAKY POWDER

CROSS-REFERENCE TO RELATED APPLICATIONS

This application is the United States national phase of International Application No. PCT/JP2017/045357 filed Dec. 18, 2017, and claims priority to Japanese Patent Application No. 2016-245056 filed on Dec. 19, 2016, the disclosures of which are hereby incorporated by reference in their entirety.

BACKGROUND OF THE INVENTION

Field of the Invention

The present invention relates to a soft magnetic flaky powder and a magnetic sheet comprising the same.

Background Art

Conventionally, a magnetic sheet containing a soft magnetic flaky powder has been used as an electromagnetic wave absorber and an antenna for RFID (Radio Frequency Identification). Moreover, in recent years, it has come to be used also for the position detection apparatus called a digitizer. This digitizer includes, for example, an electromagnetic induction type described in Japanese Patent Application Laid-Open No. 2011-22661 (Patent Document 1), which reads a high-frequency signal transmitted from a coil incorporated at the tip of a pen-shaped position indicator by a loop coil built in the position detector in the form of a panel, and thus detects the indication position. In order to improve the detection sensitivity, a sheet acting as a magnetic path of a high frequency signal is arranged at the back of the loop coil.

As a sheet acting as a magnetic path, a magnetic sheet obtained by orienting a soft magnetic flaky powder in a resin or a rubber, or a sheet obtained by laminating a soft magnetic amorphous alloy foil or the like is used. When a magnetic sheet is used, the entire detection panel can be formed as a single sheet, so that excellent uniformity can be obtained without detection failure or the like at a bonding portion such as amorphous foil.

Conventionally, a powder made of Fe—Si—Al alloy, Fe—Si alloy, Fe—Ni alloy, Fe—Al alloy, Fe—Cr alloy or the like is flattened using an attritor mill or the like, and the obtained flaky powder is added into a magnetic sheet. This is because it is important to use a soft magnetic powder having high permeability for obtaining a magnetic sheet having high permeability, and to use a flaky powder having a high aspect ratio in the magnetization direction for reducing the demagnetizing field, and to highly pack a soft magnetic powder in a magnetic sheet, as can be seen from the so-called "Ollendorff equation." For example, Japanese Patent No. 4636113 (Patent Document 2) discloses a method for producing a soft magnetic flaky powder having a high aspect ratio by increasing the major axis of the soft magnetic flaky powder, wherein a monohydric alcohol having 2 to 4 carbon atoms is used for performing flattening.

The digitizer function is applied to a smartphone, a tablet terminal or the like. However, such mobile electronic devices have severe demands for miniaturization, and high demands for thinning of a magnetic sheet to be used as a magnetic path sheet, and thus a magnetic sheet having a thinness of about 50 μm or less have been used. Furthermore, there is a tablet terminal having a liquid crystal screen as large as 10 inches, and a large area is also required for a magnetic sheet. In producing such a thin magnetic sheet by conventional methods such as a rolling or pressing method, the sheet formability of a powder has become a problem, although in producing a magnetic sheet having a conventional thickness, the sheet formability of a powder has not become a problem.

That is, when a magnetic sheet with a thickness of 50 μm or less is produced using a soft magnetic flaky powder whose major axis is too long, the directionality may not be uniform or the magnetic powder in the sheet may be coarse and dense, and thus there are many cases where sheet molding does not go well. In order to eliminate such problems at the time of sheet molding, a method of lowering a powder filling rate at the time of sheet preparation, a method of pressing a sheet after molding, or the like is performed. However, in the former method or the like, the permeability of the sheet is consequently lowered and thus the performance is lowered. Further, in the latter method or the like, an excessive stress is applied to the powder in the sheet, so that distortion is introduced to the powder. The introduction of distortion leads to an increase in the coercive force Hc of the powder, which reduces the permeability of the powder and consequently reduces the performance.

For example, a soft magnetic flaky powder having an aspect ratio of 20 or more and a large average particle diameter D50 as shown in Patent Document 2 are difficult to be used in sheet forming.

PRIOR ART DOCUMENTS

Patent Documents

Patent Document 1: Japanese Patent Application Laid-Open No. 2011-22661

Patent Document 2: Japanese Patent No. 4636113

SUMMARY OF THE INVENTION

Problems to be Solved by the Invention

There is a need for improvements of electrical resistance and corrosion resistance in a soft magnetic flaky powder, particularly a soft magnetic flaky powder used for a magnetic sheet such as a magnetic sheet for noise suppression.

Thus, an object of the present invention is to provide a soft magnetic flaky powder having high electrical resistance and high corrosion resistance, and a magnetic sheet containing the same.

Solution to the Problems

In order to solve the above problems, the present invention provides the following soft magnetic flaky powder and magnetic sheet.

[1] A soft magnetic flaky powder, comprising a plurality of soft magnetic flaky particles, wherein:

each of the plurality of soft magnetic flaky particles comprises an Fe-based alloy flaky particle and a coating layer formed on a surface of the Fe-based alloy flaky particle;

the coating layer comprises one or two or more components selected from the group consisting of chromic acid and a hydrate thereof, a metal salt of acetic acid and a hydrate thereof, and a metal salt of an inorganic acid and a hydrate thereof;

the inorganic acid is selected from the group consisting of sulfuric acid, nitric acid, chromic acid, phosphoric acid, and hydrofluoric acid;

the metal salts of the acetic acid and the inorganic acid are selected from the group consisting of a Na salt, an Al salt, a Ti salt, a Cr salt, a Ni salt, a Ga salt and a Zr salt; and the coating layer has a thickness of 10 nm or more.

[2] The soft magnetic flaky powder according to [1], wherein the thickness of the coating layer is 200 nm or less.

[3] The soft magnetic flaky powder according to [1] or [2], wherein each of the plurality of soft magnetic flaky particles has an aspect ratio of 10 to 40.

[4] The soft magnetic flaky powder according to any one of [1] to [3], wherein each of the plurality of soft magnetic flaky particles has a thickness of 0.5 to 5 (μm).

[5] The soft magnetic flaky powder according to any one of [1] to [4], wherein the average particle diameter $D_{50}$ of 20 to 60 (μm).

[6] The soft magnetic flaky powder according to any one of [1] to [5], wherein the tap density TD is 0.6 to 1.5 ($Mg/m^3$).

[7] The soft magnetic flaky powder according to any one of [1] to [6], wherein the average particle diameter $D_{50}$/the tap density TD is 30 to 100 ($10^{-6}\cdot m^4/Mg$).

[8] The soft magnetic flaky powder according to any one of [1] to [7], wherein the coercive force Hc is 176 A/m or less.

[9] A magnetic sheet, comprising the soft magnetic flaky powder according to any one of [1] to [8].

[10] The magnetic sheet according to [9], wherein the real part μ' of the permeability is 30 to 260.

[11] The magnetic sheet according to claim 9 or 10, wherein the surface resistance is $1\times10^7$ to $1\times10^{15}$ (Ω·m).

[12] The magnetic sheet according to any one of claims 9 to 11, wherein a value Z is 0.2 to 200, the value Z being calculated based on Formula (1):

$$Z=(X\times\log_{10}Y)/D \quad (1)$$

wherein X is the real part μ' of the permeability of the magnetic sheet, Y (Ω·m) is the surface resistance of the magnetic sheet, and D (nm) is the thickness of the coating layer.

Effects of the Invention

According to the present invention, a soft magnetic flaky powder having high electric resistance and corrosion resistance and a magnetic sheet comprising the same are provided. The magnetic sheet containing the soft magnetic flaky powder of the present invention is particularly useful as a magnetic sheet for noise suppression (for example, a magnetic sheet for noise suppression of electronic devices such as smartphones and tablets used at around 1 MHz band).

DETAILED DESCRIPTION OF THE INVENTION

Hereinafter, the present invention will be described.

The soft magnetic flaky powder of the present invention is an aggregate of a plurality of soft magnetic flaky particles, and each soft magnetic flaky particle contains an Fe-based alloy flaky particle and a coating layer formed on the surface of the Fe-based alloy flaky particle.

[Fe-Based Alloy Flaky Particle]

The Fe-based alloy flaky particle is a matrix of the soft magnetic flaky particle. The Fe-based alloy constituting the Fe-based alloy flaky particle is not particularly limited as long as it has soft magnetism. The Fe-based alloy constituting the Fe-based alloy flaky particle is preferably an alloy having a low coercive force and a high value of saturation magnetization. Examples of the Fe-based alloy constituting the Fe-based alloy flaky particle include, for example, Fe—Si—Al-based alloy, Fe—Si-based alloy, Fe—Al-based alloy, Fe—Ni-based alloy, Fe—Si—Cr-based alloy, Fe—Cr alloys, Fe—Si—C alloys, Fe—C alloys and the like. Generally, Fe-based alloy excellent in coercive force and saturation magnetization is Fe—Si—Al-based alloy, but according to the required characteristics, Fe—Si-based alloy, Fe—Al-based alloy, Fe—Ni alloy, Fe—Si—Cr alloy, Fe—Cr alloy, Fe—Si—C alloy, Fe—C alloy or the like may be used.

In Fe—Si—Al-based alloy, the content of Si is preferably 6.0 to 11.0 mass %, more preferably 8.0 to 10.0 mass %. The content of Al is preferably 4.0 to 10.0 mass %, more preferably 5.0 to 8.0 mass %. The balance preferably consists of Fe and unavoidable impurities.

In Fe—Si alloy, the content of Si is preferably 1.0 to 15.0 mass %, more preferably 1.0 to 10.0 mass %. The balance preferably consists of Fe and unavoidable impurities.

In Fe—Al alloy, the content of Al is preferably 1.0 to 10.0 mass %, more preferably 1.0 to 8.0 mass %. The balance preferably consists of Fe and unavoidable impurities.

In Fe—Ni alloy, the content of Ni is preferably 1.0 to 10.0 mass %, more preferably 1.0 to 8.0 mass %. The balance preferably consists of Fe and unavoidable impurities.

In Fe—Si—Cr alloy, the content of Si is preferably 6.0 to 11.0 mass %, more preferably 8.0 to 10.0 mass %. The content of Cr is preferably 1.0 to 10.0 mass %, more preferably 2.0 to 5.0 mass %. The balance preferably consists of Fe and unavoidable impurities.

In Fe—Cr alloy, the content of Cr is preferably 1.0 to 10.0 mass %, more preferably 1.0 to 8.0 mass %. The balance preferably consists of Fe and unavoidable impurities.

In Fe—Si—C based alloy, the content of Si is preferably 6.0 to 11.0 mass %, more preferably 8.0 to 10.0 mass %. The content of C is preferably 4.0 to 10.0 mass %, more preferably 5.0 to 8.0 mass %. The balance preferably consists of Fe and unavoidable impurities.

In Fe—C alloy, the content of C is preferably 1.0 to 10.0 mass %, more preferably 1.0 to 8.0 mass %. The balance preferably consists of Fe and unavoidable impurities.

[Coating Layer]

The coating layer is formed on the surface of the Fe-based alloy flaky particle, and at least a part of the surface of the soft magnetic flaky particle is formed of the coating layer. The coating layer may be formed on the entire surface of the Fe-based alloy flaky particle, or may be formed on a part of the surface of the Fe-based alloy flaky particle. When the coating layer is formed on a part of the surface of the Fe-based alloy flaky particle, the remainder of the surface of the Fe-based alloy flaky particle (a portion of the surface of the Fe-based alloy flaky particle where the coating layer is not formed) may be in the state that the surface of the Fe-based alloy flaky particle is exposed as it is, or may be in the state that an oxide layer may be formed on the surface of the Fe-based alloy flaky particle. The oxide layer is formed, for example, by oxidation of an element contained in the Fe-based alloy flaky particle by heat treatment performed in the air atmosphere before or after the formation of the coating layer.

The coating layer is formed without undergoing a chemical reaction in which an element contained in the Fe-based alloy flaky particle is used as a reactant. Therefore, it is possible to prevent an element contained in the Fe-based alloy flaky particle from being consumed for the formation of the coating layer, and thereby the performance of the Fe-based alloy flaky particle as the matrix of the soft magnetic flaky particle (for example, the magnetic properties) can be maintained. Since the coating layer is formed without undergoing a chemical reaction in which an element contained in the Fe-based alloy flaky particle is used as a reactant, a component contained in the coating layer is not covalently bonded to an element contained in the Fe-based alloy flaky particle.

The coating layer contains one or two or more components selected from the group consisting of chromic acid and a hydrate thereof, a metal salt of acetic acid and a hydrate thereof, and a metal salt of an inorganic acid and a hydrate thereof. The coating layer preferably contains one or two or more components selected from the group consisting of a metal salt of acetic acid and a hydrate thereof, and a metal salt of an inorganic acid and a hydrate thereof.

One or two or more components selected from the group consisting of chromic acid and a hydrate thereof, a metal salt of acetic acid and a hydrate thereof, and a metal salt of an inorganic acid and a hydrate thereof preferably have a melting point of 100° C. or higher, more preferably 200° C. or more, more preferably 300° C. or more.

With respect to the metal salt of the inorganic acid contained in the coating layer, the inorganic acid is selected from the group consisting of sulfuric acid, nitric acid, chromic acid, phosphoric acid, and hydrofluoric acid, and with respect to the metal salts of the acetic acid and the inorganic acid contained in the coating layer, the metal salts are selected from the group consisting of a Na salt, an Al salt, a Ti salt, a Cr salt, a Ni salt, a Ga salt and a Zr salt. The inorganic acid is preferably selected from the group consisting of sulfuric acid, nitric acid, chromic acid, phosphoric acid and hydrofluoric acid, and is more preferably selected from the group consisting of sulfuric acid, chromic acid, phosphoric acid and hydrofluoric acid. The metal salt is preferably selected from the group consisting of a Na salt, an Al salt, a Ti salt, a Cr salt, a Ni salt and a Zr salt, and is more preferably selected from the group consisting of a Na salt, an Al salt, a Ti salt, a Cr salt and a Ni salt. A Na salt, an Al salt, a Ti salt, a Cr salt, a Ni salt, a Ga salt and a Zr salt tend to easily form a coating layer and have a stable structure. Therefore, one or two or more metal salts selected from the group consisting of a Na salt, an Al salt, a Ti salt, a Cr salt, a Ni salt, a Ga salt and a Zr salt contained in the coating layer can improve the electrical resistance and corrosion resistance of the soft magnetic flaky particle (and thus the electrical resistance and corrosion resistance of the soft magnetic flaky powder and the magnetic sheet containing the soft magnetic flaky powder).

The coating layer has an insulating property. Therefore, in a magnetic sheet produced by mixing a soft magnetic flaky powder with an insulating material such as resin or rubber, the coating layer prevents contact between soft magnetic flaky particles, thereby suppressing a decrease in the real part μ' of the permeability due to generation of eddy current, in addition to suppressing a decrease in the imaginary part μ" of the permeability.

The coating layer may contain other solid components. Examples of the other solid components include silicon hydroxide, silicon dioxide and the like. Silicon hydroxide, silicon dioxide and the like are formed by reaction of silicon sulfide added to a coating solution for forming a coating layer with water, oxygen and the like.

The coating layer has a thickness of 10 nm or more. As the thickness of the coating layer is increased, the electrical resistance and corrosion resistance of the soft magnetic flaky particle are improved (and thus the electrical resistance and corrosion resistance of the soft magnetic flaky powder and the magnetic sheet containing the soft magnetic flaky powder are improved). The thickness of the coating layer is preferably 20 nm or more, more preferably 25 nm or more, and still more preferably 30 nm or more. If the thickness of the coating layer is less than 10 nm, the electrical resistance and corrosion resistance of the soft magnetic flaky particle will become insufficient (and thus the electrical resistance and corrosion resistance of the soft magnetic flaky powder and the magnetic sheet comprising the same will become insufficient). If the thickness of the coating layer is less than 10 nm, the soft magnetic flaky particles may rub against each other to cause the coating layer to peel off.

The upper limit of the thickness of the coating layer is not particularly limited. However, if the thickness of the coating layer is too large, the improvement of the electrical resistance and corrosion resistance corresponding to the increase of the coating layer cannot be obtained. In addition, if the thickness of the coating layer is too large, the coercive force of the soft magnetic flaky powder will tend to be large, and the proportion of the Fe-based alloy flaky particles in the magnetic sheet containing the soft magnetic flaky powder will be small. As a result, there is a possibility that the real part μ' of the permeability in the high frequency region of the magnetic sheet may be reduced. Therefore, the thickness of the coating layer is preferably 200 nm or less, more preferably 150 nm or less, and still more preferably 100 nm or less.

The thickness of the coating layer is calculated as an average value by measuring the thickness of any 20 points of the coating layer using a transmission electron microscope.

[Aspect Ratio]

The aspect ratio of the soft magnetic flaky particle is the ratio of the length of the soft magnetic flaky particle in the longitudinal direction to the thickness of the soft magnetic flaky particle (the length in the longitudinal direction/the thickness). The aspect ratio of the soft magnetic flaky particle is calculated as follows. The soft magnetic flaky particle is observed with a scanning electron microscope, and the length L of the longest line segment that can be drawn within the outline in a plan view is measured. The length L is measured for 50 soft magnetic flaky particles randomly extracted from the soft magnetic flaky powder, and the average value Lay thereof is calculated. The soft magnetic flaky particle is embedded in a resin and polished, and the polished surface is observed with an optical microscope. Based on the optical microscope image, the thickness direction of the soft magnetic flaky particle is specified, the maximum thickness tm and the minimum thickness to are measured, and the average thickness ((tm+tn)/2) is calculated. The average thickness ((tm+tn)/2) is calculated for 50 soft magnetic flaky particles randomly extracted from the soft magnetic flaky powder, and the average value tav is calculated. The aspect ratio of the soft magnetic flaky particle is calculated based on the formula: Aspect ratio=Average value Lav/Average value tav.

The aspect ratio of the soft magnetic flaky particle is preferably 10 to 40, more preferably 13 to 37, and still more preferably 15 to 35. If the aspect ratio of the soft magnetic flaky particles is less than 10, the real part μ' of the permeability in the high frequency region of the magnetic sheet containing the soft magnetic flaky powder will tend to decrease. If the aspect ratio of the soft magnetic flaky particle exceeds 40, the soft magnetic flaky particle will easily come into contact with other soft magnetic flaky particles in the magnetic sheet containing the soft magnetic flaky powder, and magnetic loss due to eddy current will tend to occur.

[Thickness]

The thickness of the soft magnetic flaky particles is preferably 0.5 to 5 μm, more preferably 0.5 to 4.5 μm, and still more preferably 0.5 to 4 μm. If the thickness of the soft magnetic flaky particle is less than 0.5 μm, the proportion of Fe-based alloy flaky particles in the magnetic sheet containing the soft magnetic flaky powder will become small, so that the real part μ' of the permeability in the high frequency region of the magnetic sheet may decrease. If the thickness of the soft magnetic flaky particle exceeds 5 μm, the problems such as difficulty in mixing with materials such as rubber and resin, increase in surface unevenness of the magnetic sheet, and the like may occur. The thickness of the soft magnetic flaky particle is calculated as follows. The soft magnetic flaky particle is embedded in a resin and polished, and the polished surface is observed with an optical microscope. Based on the optical microscope image, the thickness direction of the soft magnetic flaky particle is specified, the maximum thickness tm and the minimum thickness to are measured, and the average thickness ((tm+tn)/2) is calculated. The average thickness ((tm+tn)/2) is calculated for 50 soft magnetic flaky particles randomly extracted from the soft magnetic flaky powder, and the average thickness is calculated.

[Average Particle Size $D_{50}$]

The average particle size $D_{50}$ of the soft magnetic flaky powder is preferably 20 to 60 μm, more preferably 30 to 60 μm. If the average particle diameter $D_{50}$ is less than 20 μm, the aspect ratio will decrease, and the real part μ' of the permeability in the high frequency region of the magnetic sheet containing the soft magnetic flaky powder will tend to decrease. If the average particle diameter $D_{50}$ is too large, the sheet formability of the soft magnetic flaky powder will be reduced. In particular, if the average particle diameter $D_{50}$ exceeds 60 μm, irregularities on the surface of the magnetic sheet will tend to be noticeable, and a special treatment will be required to prevent this, which is not preferable in terms of performance, cost and the like. If the average particle diameter $D_{50}$ exceeds 60 μm, soft magnetic flaky particles will easily come into contact with each other in the magnetic sheet containing the soft magnetic flaky powder, and magnetic loss due to eddy current will tend to occur.

[Tap Density TD]

The tap density TD of the soft magnetic flaky powder is preferably 0.6 to 1.5 $Mg/m^3$, more preferably 0.6 to 1.2 $Mg/m^3$. $Mg/m^3$ is synonymous with g/cc. The tap density TD tends to monotonously decrease as processing progresses (as processing time increases). If the tap density TD is less than 0.6 $Mg/m^3$, the average particle diameter $D_{50}$ will tend to be small, which will lead to an increase in coercive force. On the other hand, if the tap density exceeds 1.5 $Mg/m^3$, the average particle diameter $D_{50}$ will tend to increase, and the filling ratio of the soft magnetic flaky powder to the magnetic sheet will decrease, so that the real part μ' of the permeability in the high frequency region of the magnetic sheet will tends to decrease. The tap density is measured in accordance with JIS Z 2512.

[Average Particle Size $D_{50}$/Tap Density TD]

The average particle size $D_{50}$ of the soft magnetic flaky powder/the tap density TD of the soft magnetic flaky powder is preferably 30 to 100 ($10^{-6}\cdot m^4/Mg$), more preferably 30 to 80 ($10^{-6}\cdot m^4/Mg$). If $D_{50}$/TD is less than 30 ($10^{-6}\cdot m^4/Mg$), the aspect ratio of the soft magnetic flaky particle will become small, and the filling ratio of the soft magnetic flaky powder to the magnetic sheet will become low, so that the real part μ' of the permeability in the high frequency region of the magnetic sheet will tend to decrease. On the other hand, if $D_{50}$/TD exceeds 100 ($10^{-6}\cdot m^4/Mg$), the aspect ratio of the soft magnetic flaky particle will become large, and the filling ratio of the soft magnetic flaky powder to the magnetic sheet will become high, so that the formability of the magnetic sheet may be deteriorated.

[Coercive Force Hc]

The coercive force Hc of the soft magnetic flaky powder is preferably 176 A/m or less, more preferably 108 A/m or less. If the coercive force Hc exceeds 176 A/m, the real part μ' of the permeability in the high frequency region of the magnetic sheet containing the soft magnetic flaky powder will be lowered, so that the noise suppression performance will be deteriorated. The coercive force Hc is preferably 32 A/m or more, more preferably 40 A/m or more. The coercive force Hc is a coercive force measured by applying a magnetic field (144 kA/m) in the longitudinal direction of the soft magnetic flaky particle, which is calculated based on the value measured by filling a resin container with the soft magnetic flaky powder and magnetizing in the diameter direction of the container. The longitudinal direction and the thickness direction of the soft magnetic flaky particle filled in the container correspond to the diameter direction and the height direction of the container, respectively, so that the value measured by magnetizing in the container diameter direction is the coercive force in the longitudinal direction, whereas the value measured by magnetizing in the height direction of the container is the coercive force in the thickness direction.

[Real part μ' of Permeability]

The complex permeability μ is represented by $\mu=\mu'-j\mu''$ (wherein μ' is a real part, p" is an imaginary part, j is an imaginary unit ($(j)^2=-1$)). In the present specification, all of the permeability μ", the real part μ' of the permeability, and the imaginary part μ" of the permeability mean a relative permeability, which is a ratio to the permeability of vacuum, and has a dimensionless unit. The real part μ' of the permeability of the magnetic sheet containing the soft magnetic flaky powder is preferably 30 to 260, more preferably 50 to 260, and still more preferably 70 to 260. If the real part μ' of the permeability is less than 30, this may reduce the permeability and performance of the magnetic sheet. If the real part μ' of the permeability exceeds 260, the thickness of the coating layer will be too thin, and the electrical resistance and the corrosion resistance of the soft magnetic flaky powder may be insufficient. The complex permeability μ is obtained by cutting out a doughnut-shaped sample having an outer diameter of 7 mm and an inner diameter of 3 mm from a magnetic sheet containing the soft magnetic flaky powder (the volume filling rate of the flaky powder in the magnetic sheet is approximately 50%), measuring the impedance characteristics at 13.56 MHz at room temperature using an impedance measuring instrument, and calculating from the measurement results.

[Surface Resistance]

The surface resistance of the magnetic sheet containing the soft magnetic flaky powder is preferably $1\times10^7$ to $1\times10^{15}$ Q·m, more preferably $1\times10^8$ to $1\times10^{15}$ Q·m, still more preferably $1\times10^9$ to $1\times10^{15}$ Ω·m. If the surface resistance is less than $1\times10^{7}$ Ω·m, the surface resistance of the magnetic sheet may be reduced, and the performance may be reduced. If the surface resistance exceeds $1\times10^{15}$ Ω·m, the permeability of the magnetic sheet may be reduced, and the performance may be reduced. The surface resistance is calculated from the results obtained by measuring the electrical resistance of the surface of the magnetic sheet containing the soft magnetic flaky powder (the volume filling ratio of the flaky powder in the magnetic sheet is about 50%) using a two-terminal method.

12. The magnetic sheet according to any one of claims 9 to 11, wherein a value Z is 0.2 to 200, the value Z being calculated based on Formula (1):

$$Z=(X\times\log_{10}Y)/D \quad (1)$$

wherein X is the real part μ' of the permeability of the magnetic sheet, Y (Ω·m) is the surface resistance of the magnetic sheet, and D (nm) is the thickness of the coating layer.

[Z Value]

With respect to the magnetic sheet containing the soft magnetic flaky powder, a value Z is preferably 0.2 to 200, more preferably 50 to 200, and still more preferably 100 to 200. The value Z is calculated based on Formula (1):

$$Z=(X\times\log_{10}Y)/D \quad (1)$$

wherein X is the real part μ' of the permeability of the magnetic sheet, Y (Ω·m) is the surface resistance of the magnetic sheet, and D (nm) is the thickness of the coating layer. If Z is smaller than 0.2, the proportion of the soft magnetic flaky powder in the magnetic sheet will tend to be small, and the real part μ' of the permeability in the high frequency region of the magnetic sheet will tend to decrease. If Z is larger than 200, the soft magnetic flaky particles may rub against each other during the production of the magnetic sheet, and the coating layer may be peeled off.

[Method for Producing Soft Magnetic Flaky Powder]

The soft magnetic flaky powder of the present invention can be produced by a method including a raw material powder preparation step, a flat processing step, a heat treatment step and a coating step.

<Raw Material Powder Preparation Step>

A soft magnetic alloy powder is used as a raw material powder. The soft magnetic alloy powder used as a raw material powder is an Fe-based alloy powder. The Fe-based alloy powder is not particularly limited as long as it is a soft magnetic alloy powder, but is preferably a powder having a low coercive force and a high value of saturation magnetization. The Fe-based alloy powder is an aggregate of a plurality of Fe-based alloy particles, and the shape of each Fe-based alloy particle is, for example, spherical. Examples of the Fe-based alloy constituting the Fe-based alloy particles include, for example, an Fe—Si—Al-based alloy, an Fe—Si-based alloy, an Fe—Al-based alloy, an Fe—Ni-based alloy, an Fe—Si—Cr-based alloy, an Fe—Cr-based alloy, an Fe—Si—C-based alloy, an Fe—C-based alloy and the like. In general, Fe-based alloys having excellent values of coercive force and saturation magnetization are Fe—Si—Al-based alloys, but according to the required characteristics, an Fe—Si-based alloy, an Fe—Al-based alloy, an Fe—Ni alloy, an Fe—Si—Cr alloy, an Fe—Cr alloy, an Fe—Si—C alloy, an Fe—C alloy, or the like may be used. Specific Examples of the composition of the Fe-based alloy are the same as described above.

The Fe-based alloy powder can be produced, for example, by various atomizing methods such as a gas atomizing method, a water atomizing method, a disk atomizing method, or a pulverizing method implemented after alloying by melting. Since it is preferable that the amount of oxygen contained in the Fe-based alloy powder is small, the Fe-based alloy powder is preferably produced by a gas atomization method, and more preferably produced by a gas atomization method using an inert gas. The Fe-based alloy powder can be manufactured without problems by the disc atomizing method or the water atomizing method, but from the viewpoint of mass productivity, the gas atomizing method is excellent. Since the powder produced by the atomization method has a near spherical shape, flattening tends to progress more than the powder produced by the pulverization method using attritor processing or the like. Since the powder produced by the pulverization method has a particle diameter smaller than that of the atomized powder, the generation of projections on the surface of the magnetic sheet tends to be suppressed.

The particle size of the Fe-based alloy powder is not particularly limited, but it is classified into a desired particle size according to the purpose of adjusting the average particle size after flattening, the purpose of removing the powder containing a large amount of oxygen, and other production purposes. The obtained Fe-based alloy powder may be used as a raw material powder.

<Flat Processing Step>

After the raw material powder preparation step, the Fe-based alloy powder is flattened. Thus, an Fe-based alloy flaky powder is obtained. The flat processing method is not particularly limited, and flat processing of the Fe-based alloy powder can be performed using, for example, an attritor, a ball mill, a vibration mill, or the like. Among them, it is preferable to use an attritor that is relatively excellent in flat processing ability. When dry flattening is carried out, it is preferable to use an inert gas. When flat processing is performed by wet processing, it is preferable to use an organic solvent.

The type of the organic solvent used in wet flat processing is not particularly limited. The amount of the organic solvent added is preferably 100 parts by mass or more, more preferably 200 parts by mass or more, with respect to 100 parts by mass of the Fe-based alloy powder. The upper limit of the additive amount of the organic solvent is not particularly limited, and can be appropriately adjusted according to the balance between the required size and shape of flaky powder and productivity. The organic solvent may be a water-containing organic solvent, but in order to lower the oxygen content, the water concentration in the organic solvent is preferably 0.002 parts by mass or less with respect to 100 parts by mass of the organic solvent. A flattening aid may be used together with the organic solvent, but in order to suppress oxidation, the additive amount of the flattening aid is preferably 5 parts by mass or less with respect to 100 parts by mass of the Fe-based alloy powder.

<Heat Treatment Step>

After the flat processing step, the Fe-based alloy flaky powder is heat treated. By heat treating the Fe-based alloy flaky powder, lattice defects in the Fe-based alloy flaky powder generated by flat processing such as attritor processing are recovered, the coercive force of the Fe-based alloy flaky powder is reduced, and the permeability of the Fe-based alloy flaky powder is improved. The heat treatment apparatus is not particularly limited as long as the desired heat treatment temperature can be realized. The heat treatment temperature is preferably 300 to 800° C., more preferably 500 to 800° C. By performing the heat treatment at such a temperature, the coercive force of the Fe-based alloy flaky powder is reduced, and a soft magnetic flaky powder with high permeability can be obtained. If the heat treatment temperature is less than 300° C., the effect of the heat treatment will become insufficient. On the other hand, if the heat treatment temperature exceeds 800° C., sintering may occur depending on the composition of the material, which may result in coarse lumps and many projections on the surface of the magnetic sheet. The heat treatment time is not particularly limited, and can be appropriately adjusted according to the amount of treatment, productivity, and the like. However, if the heat treatment time becomes long, the productivity will decrease. Thus, the heat treatment time is preferably 5 hours or less.

In the heat treatment step, when the heat treatment atmosphere is air, oxidation of the Fe-based alloy flaky powder proceeds. Therefore, in order to suppress oxidation of the Fe-based alloy flaky powder, it is preferable to heat-treat the Fe-based alloy flaky powder in vacuum or in an inert gas (for example, argon, nitrogen). From the viewpoint of surface treatment, the Fe-based alloy flaky powder may be heat-treated in nitrogen gas, but in that case, the value of coercive force tends to be increased, and the permeability tends to be lowered compared to when heat-treated in vacuum.

<Coating Step>

After the heat treatment step, a coating layer is formed on the surface of the Fe-based alloy flaky powder. The coating layer can be formed by the following method. The coating step can be performed in the atmosphere, in vacuum or in an inert gas (e.g., argon, nitrogen).

First, a coating solution is prepared. The coating solution contains one or two or more components selected from the group consisting of chromic acid and a hydrate thereof, a metal salt of acetic acid and a hydrate thereof, and a metal salt of an inorganic acids and a hydrate thereof. The solvent of the coating solution is not particularly limited as long as it evaporates by the drying process. The solvent of the coating solution is, for example, water, and the coating solution is, for example, an aqueous solution. With respect to the metal salt of inorganic acid, the inorganic acid is selected from the group consisting of sulfuric acid, nitric acid, chromic acid, phosphoric acid, and hydrofluoric acid. The inorganic acid is preferably selected from the group consisting of sulfuric acid, nitric acid, chromic acid, phosphoric acid and hydrofluoric acid, and is more preferably selected from the group consisting of sulfuric acid, chromic acid, phosphoric acid and hydrofluoric acid. The total amount of one or two or more components selected from the group consisting of chromic acid and a hydrate thereof, a metal salt of acetic acid and a hydrate thereof, and a metal salt of an inorganic acid and a hydrate thereof contained in the coating solution can be appropriately adjusted so that the desired composition, thickness, or the like of the coating layer can be realized. The total amount of one or two or more components selected from the group consisting of chromic acid and a hydrate thereof, a metal salt of acetic acid and a hydrate thereof, and a metal salt of an inorganic acid and a hydrate thereof contained in the coating solution is preferably 1 to 50 parts by mass, more preferably 5 to 50 parts by mass, still more preferably 10 to 50 parts by mass, with respect to 100 parts by mass of the solvent (e.g., water).

Next, the coating solution and the Fe-based alloy flaky powder are mixed, and the Fe-based alloy flaky powder is separated from the coating solution. Thus, the Fe-based alloy flaky powder whose surface is covered with the coating liquid is obtained. The method of mixing the coating solution and the Fe-based alloy flaky powder is not particularly limited. The mixing of the coating solution and the Fe-based alloy flaky powder can be performed using, for example, an attritor, a ball mill, a vibration mill or the like. Among them, it is preferable to use a ball mill which is relatively excellent in covering ability. When an attritor or a vibration mill is used, the Fe-based alloy flaky powder after the heat treatment may be strained again. The mixing ratio (mass ratio) of the coating solution and the Fe-based alloy flaky powder can be appropriately adjusted so that the surface (preferably the entire surface) of the Fe-based alloy flaky powder is coated with the coating solution.

Next, the Fe-based alloy flaky powder is dried, the water is evaporated from the coating solution that covers the surface of the Fe-based alloy flaky powder, and one or two or more components selected from the group consisting of chromic acid and a hydrate thereof, a metal salt of acetic acid and a hydrate thereof, and a metal salt of an inorganic acid and a hydrate thereof is precipitated. The drying temperature is preferably 70 to 300° C., more preferably 100 to 300° C., and the drying time is preferably 1 to 10 hours, more preferably 2 to 10 hours. Thus, the coating layer can be formed on the surface of the Fe-based alloy flaky powder. The coating layer is formed without a chemical reaction in which an element contained in the Fe-based alloy flaky particle is used as a reactant. This can prevent the elements contained in the Fe-based alloy flaky particle from being consumed for the formation of the coating layer, and thus can maintain the performance of the Fe-based alloy flaky particle, which is the base of the soft magnetic flaky particle. Since the coating layer is formed without a chemical reaction in which the elements contained in the Fe-based alloy flaky particle is used as a reactant, the components contained in the coating layer is not covalently bonded to the elements contained in the Fe-based alloy flaky particle.

After the coating step, the soft magnetic flaky powder obtained by the coating step may be heat-treated. Thus, it is possible to prevent a decrease in the filling ratio of the soft magnetic flaky powder to the magnetic sheet due to the moisture contained in the soft magnetic flaky powder. In the heat treatment step after the covering step, when the heat treatment atmosphere is the air, oxidation of the soft magnetic flaky powder proceeds. Therefore, in order to suppress the oxidation of the soft magnetic flaky powder, it is preferable to heat treat the soft magnetic flaky powder in vacuum or in an inert gas (for example, argon, nitrogen). In the heat treatment step after the covering step, the heat treatment temperature is preferably 70 to 300° C., more preferably 100 to 300° C., and the heat treatment time is preferably 1 to 10 hours, more preferably 2 to 10 hours.

The use of a surface-treated soft magnetic flaky powder may be preferable from the viewpoint of enhancing the insulation of the magnetic sheet containing the soft magnetic flaky powder. The surface treatment step may be performed before or after the heat treatment step as needed. For example, the heat treatment may be performed in an atmosphere containing a small amount of active gas for the surface treatment. Moreover, it is also possible to improve corrosion resistance, dispersibility in rubber, and the like by the surface treatment, typically, the conventionally-proposed treatment with a cyan-based coupling agent.

The production of the magnetic sheet containing the soft magnetic flaky powder can be carried out using the soft magnetic flaky powder in accordance with the conventionally-proposed method. For example, it can be produced by: mixing the soft magnetic flaky powder with a solution obtained by dissolving chlorinated polyethylene or the like in toluene; applying the obtained mixture to a substrate made of synthetic resin such as polyester resin; drying the obtained product, and compressing the dried product with various presses, rolls, etc.

EXAMPLES

Hereinafter, the present invention will be specifically described based on Examples.

1. Production of Soft Magnetic Flaky Powder

A soft magnetic flaky powder was produced by the following raw material powder preparation step, flat processing step, heat treatment step and coating step.

(1) Raw Material Powder Preparation Process

Using water atomization method (WA), gas atomization method (GA) or disk atomization method (DA), the alloy powders with the compositions shown in Table 1 and Table 2 are produced and classified to 150 μm or less. The obtained powders were used as raw material powders.

The gas atomization was carried out by using an alumina crucible for melting, pouring a molten alloy from a 5 mm diameter nozzle under the crucible, and spraying high pressure argon to it.

Disk atomization was performed by using an alumina crucible for melting, pouring molten alloy from a 1 to 5 mm diameter nozzle under the crucible, and dropping it onto a disk rotating at high speed. The rotational speed was 40000 to 60000 rpm. In disc atomization, the molten alloy is quenched and solidified by the disc to obtain a powder.

Water atomization was carried out by using an alumina crucible for melting, pouring molten alloy from a 5 mm diameter nozzle under the crucible, and spraying high pressure water to it.

(2) Flat Processing Process

The raw material powder was flat-processed by the attritor. The attritor was loaded with a ball of 4.8 mm in diameter made of SUJ2 into the stirring vessel together with the raw material powder and industrial ethanol, and the blade rotation speed was 300 rpm.

The additive amount of industrial ethanol was 200 to 500 parts by mass with respect to 100 parts by mass of the raw material powder. The flattening aid was not added, or its additive amount was 1 to 5 parts by mass with respect to 100 parts by mass of the raw material powder.

(3) Heat Treatment Step

After the flattening step, the flattened powder taken out of the stirring vessel was transferred to a stainless steel pan and dried at 80° C. for 24 hours. The flaky powder thus obtained was heat-treated under vacuum, in argon (Ar), in nitrogen or in the air atmosphere, at the temperature shown in Table 1 and Table 2 for 2 hours.

(4) Coating Step

Additive amounts shown in Table 1 and Table 2 for the solutes shown in Tables 1 and 2 (In Table 1 and Table 2, the additive amount of the solute is expressed as parts by mass of the solute with respect to 100 parts by mass of water) was added and mixed to prepare a coating solution. The heat treated flaky powder and the coating solution were mixed using an attritor mill (AM), a ball mill (BM) or a vibration mill (VM). After mixing, the removed flaky powder was dried at 100° C. for 2 hours. Thus, the solute was deposited, and a coating layer was formed on the surface of the flaky powder.

(5) Heat Treatment Step

After the covering step, the flaky powder was heat treated in air at 100° C. for 2 hours. Thus, the moisture, which causes a decrease in the filling rate of the flaky powder at the time of magnetic sheet preparation, was evaporated.

2. Evaluation of Soft Magnetic Flaky Powder

With respect to the obtained soft magnetic flaky powder, the thickness of the coating layer, the average particle diameter, the tap density, the thickness and aspect ratio of the constituent particles, and the coercive force were evaluated. The evaluation results are shown in Tables 3 and 4.

The thickness of the coating layer was evaluated by a transmission electron microscope (HF-2000 FE TEM manufactured by Hitachi, Ltd.), and the average particle diameter was evaluated by a laser diffraction method (Microtrac MT 3000 manufactured by Nikkiso Co., Ltd.). The tap density was evaluated by filling a flaky powder of about 20 g into a cylinder with a volume of 100 $cm^3$, and measuring the packing density when the drop height was 10 mm and the number of taps was 200 times. The coercive force was measured by filling flaky powder in a resin container having a diameter of 6 mm and a height of 8 mm, and magnetizing in the height direction of the container, or magnetizing in the diameter direction. The measurements of the thickness and the aspect ratio of the constituent particles were performed according to the above-mentioned methods. For measurement of coercive force, COERCIMETER HC 801 manufactured by Qumano was used. In the flaky powder, since the height direction of the filled cylinder is the thickness direction, when magnetized in the height direction of the container, the coercive force in the thickness direction of the flaky powder is measured, whereas, when magnetized in the diameter direction of the container, the coercive force in the longitudinal direction of the flaky powder is measured. The applied magnetic field was 144 kA/m.

3. Preparation and Evaluation of Magnetic Sheet

The obtained flaky powder was mixed with chlorinated polyethylene dissolved in toluene, and dispersed. The dispersion was applied to a polyester resin sheet to a thickness of about 100 μm and dried at normal temperature and humidity. Then, it press-processed by 130° C. and the pressure of 15 Mpa, and obtained the magnetic sheet. The size of the magnetic sheet is 150 mm×150 mm and the thickness is 50 μm. The volume filling rate of the flaky powder in the magnetic sheet was about 50% in all cases.

With respect to the obtained magnetic sheet, the permeability, the electric resistance and the corrosion resistance were evaluated. The evaluation results are shown in Tables 3 and 4. In Tables 3 and 4, "index value of electric resistance" means $\log_{10}$ Y, wherein Y (Ω·m) is the surface resistance of the magnetic sheet. In Tables 3 and 4, the Z value is defined as a value calculated based on Formula (1):

$$Z=(X\times\log_{10}Y)/D \quad (1)$$

wherein X is the real part μ' of the permeability of the magnetic sheet, Y (Ω·m) is the surface resistance of the magnetic sheet, and D (nm) is the thickness of the coating layer.

The complex permeability μ is represented by μ=μ'−jp" (wherein μ' is a real part, μ" is an imaginary part, j is an imaginary unit ($(j)^2=-1$)). In the present specification, all of the permeability μ, the real part μ' of the permeability and the imaginary part μ" of the permeability mean a relative permeability, which is a ratio to the permeability of vacuum, and has a dimensionless unit. The complex permeability μ (the real part of the complex permeability: μ', the imaginary part of the complex permeability: μ") was calculated from the measurement results obtained by cutting out from the magnetic sheet a donut-shaped sample with an outer diameter of 7 mm and an inner diameter of 3 mm, and measuring the impedance characteristic at 13.56 MHz at room temperature using an impedance measurement instrument (E4991B impedance analyzer manufactured by KEYSIGHT Co., Ltd.). The electrical resistance was measured on the surface of the magnetic sheet by a two-terminal method. For the measurement of the electrical resistance, Hiresta-UX MCP-HT800 manufactured by Mitsubishi Analytech Co., Ltd. was used. The corrosion resistance was evaluated in a saltwater immersion experiment using a magnetic sheet. The salt water immersion experiment was performed under very severe conditions of a concentration of 20%, a temperature of 60° C., and a time of 100 hours. The evaluation criteria of corrosion resistance were as follows:

"A": The discolored area is 5% or less of the magnetic sheet (10 mm square).

"B": The discolored area is 5% or more and 20% or less of the magnetic sheet (10 mm square).

"C": The discolored area is more than 20% and not more than 50% of the magnetic sheet (10 mm square).

TABLE 1

| | Raw material powder preparation step | | Heat treatment step | | |
|---|---|---|---|---|---|
| No | Powder composition (mass %) | Powder preparation method | Heat treatment temperature | Heat treatment time | Heat treatment atmosphere |
| 1 | Fe—9.5Si—5.5C | GA | 800° C. | 2 hours | Ar |
| 2 | Fe—9.5Si—5.5C | GA | 800° C. | 2 hours | Ar |
| 3 | Fe—9.5Si—5.5C | GA | 800° C. | 2 hours | Ar |
| 4 | Fe—9.5Si—5.5C | GA | 800° C. | 2 hours | Ar |
| 5 | Fe—9.5Si—5.5C | GA | 800° C. | 2 hours | Ar |
| 6 | Fe—9.5Si—5.5C | GA | 800° C. | 2 hours | Ar |
| 7 | Fe—9.5Si—6.0Al | GA | 800° C. | 2 hours | Ar |
| 8 | Fe—9.5Si—6.0Al | GA | 800° C. | 2 hours | Ar |
| 9 | Fe—9.5Si—6.0Al | GA | 800° C. | 2 hours | Ar |
| 10 | Fe—9.5Si—6.0Al | GA | 800° C. | 2 hours | Ar |
| 11 | Fe—9.5Si—6.0Al | GA | 800° C. | 2 hours | Ar |
| 12 | Fe—9.5Si—6.0Al | GA | 800° C. | 2 hours | Ar |
| 13 | Fe—9.5Si—6.5Al | GA | 800° C. | 2 hours | Ar |
| 14 | Fe—9.5Si—6.5Al | GA | 800° C. | 2 hours | Ar |
| 15 | Fe—9.5Si—6.5Al | GA | 800° C. | 2 hours | Ar |
| 16 | Fe—9.5Si—6.5Al | GA | 800° C. | 2 hours | Ar |
| 17 | Fe—9.5Si—6.5Al | GA | 800° C. | 2 hours | Ar |
| 18 | Fe—9.5Si—6.5Al | GA | 800° C. | 2 hours | Ar |
| 19 | Fe—1.0Al | GA | 100° C. | 2 hours | Vacuum |
| 20 | Fe—3.0Al | GA | 200° C. | 2 hours | Vacuum |
| 21 | Fe—6.0Al | GA | 300° C. | 2 hours | Vacuum |
| 22 | Fe—1.0Ni | GA | 400° C. | 2 hours | Vacuum |
| 23 | Fe—3.0Ni | GA | 500° C. | 2 hours | Vacuum |
| 24 | Fe—6.0Ni | GA | 600° C. | 2 hours | Vacuum |

| | Coating step | | | | |
|---|---|---|---|---|---|
| | | Coating solution | | | |
| No | Coating method | Solute | Additive Amount of solute (*1) | Solvent | Remarks |
| 1 | BM | Aluminium sulfate | 0.5 | Water | Comparative Ex. |
| 2 | BM | Nickel chromate | 0.7 | Water | Comparative Ex. |
| 3 | VM | Gallium nitrate | 1.0 | Water | Comparative Ex. |
| 4 | VM | Aluminium chromate | 5.0 | Water | Inventive Ex. |
| 5 | AM | Zirconium acetate | 15 | Water | Inventive Ex. |
| 6 | AM | Titanium phosphate | 35 | Water | Inventive Ex. |
| 7 | BM | Chromium nitrate | 40 | Water | Inventive Ex. |
| 8 | BM | Zirconium phosphate | 32 | Water | Inventive Ex. |
| 9 | BM | Sodium nitrate | 3.6 | Water | Inventive Ex. |
| 10 | BM | Nickel phosphate | 2.0 | Water | Inventive Ex. |
| 11 | BM | Titanium acetate | 1.2 | Water | Inventive Ex. |
| 12 | BM | Titanium phosphate | 0.5 | Water | Comparative Ex. |
| 13 | BM | Gallium chromate | 0.9 | Water | Comparative Ex. |
| 14 | BM | Sodium nitrate | 0.6 | Water | Comparative Ex. |
| 15 | BM | Nickel phosphate | 38 | Water | Inventive Ex. |
| 16 | BM | Zirconium sulfate | 43 | Water | Inventive Ex. |
| 17 | BM | Gallium nitrate | 6.4 | Water | Inventive Ex. |
| 18 | BM | Nickel phosphate | 1.3 | Water | Inventive Ex. |
| 19 | BM | Titanium sulfate | 2.1 | Water | Inventive Ex. |
| 20 | BM | Chromium acetate | 5.4 | Water | Inventive Ex. |
| 21 | BM | Calcium nitrate | 45 | Water | Inventive Ex. |
| 22 | BM | Sodium chromate | 2.0 | Water | Inventive Ex. |
| 23 | BM | Sodium sulfate | 22 | Water | Inventive Ex. |
| 24 | BM | Gallium fluoride | 17 | Water | Inventive Ex. |

(*1): The additive amount of solute is expressed as parts by mass with respect to 100 parts by mass of water.

TABLE 2

| No | Raw material powder preparation step | | Heat treatment step | | |
|---|---|---|---|---|---|
| | Powder composition (mass %) | Powder preparation method | Heat treatment temperature | Heat treatment time | Heat treatment atmosphere |
| 25 | Fe—1.0Cr | GA | 700° C. | 2 hours | Vacuum |
| 26 | Fe—3.0Cr | GA | 400° C. | 2 hours | $N_2$ |
| 27 | Fe—6.0Cr | GA | 400° C. | 2 hours | Air |
| 28 | Fe—1.0C | GA | 400° C. | 2 hours | Vacuum |
| 29 | Fe—3.0C | GA | 400° C. | 2 hours | $N_2$ |
| 30 | Fe—6.0C | GA | 400° C. | 2 hours | Air |
| 31 | Fe—3Si | GA | 800° C. | 2 hours | Ar |
| 32 | Fe—3Si | GA | 800° C. | 2 hours | Ar |
| 33 | Fe—6Si | GA | 400° C. | 2 hours | Ar |
| 34 | Fe—6Si | GA | 400° C. | 2 hours | Ar |
| 35 | Fe—10Si | GA | 400° C. | 2 hours | Ar |
| 36 | Fe—10Si | GA | 400° C. | 2 hours | Ar |
| 37 | Fe—10Si—2Cr | GA | 800° C. | 2 hours | Ar |
| 38 | Fe—10Si—2Cr | DA | 800° C. | 2 hours | Vacuum |
| 39 | Fe—10Si—2Cr | WA | 800° C. | 2 hours | Air |
| 40 | Fe—10Si—5Cr | GA | 300° C. | 2 hours | Ar |
| 41 | Fe—10Si—5Cr | DA | 300° C. | 2 hours | Vacuum |
| 42 | Fe—10Si—5Cr | WA | 300° C. | 2 hours | Air |

| No | Coating step | | | | |
|---|---|---|---|---|---|
| | | Coating solution | | | |
| | Coating method | Solute | Additive Amount of solute (*1) | Solvent | Remarks |
| 25 | BM | Aluminium nitrate | 48 | Water | Inventive Ex. |
| 26 | BM | Chromium sulfate | 1.3 | Water | Inventive Ex. |
| 27 | AM | Magnesium phosphate | 5.2 | Water | Inventive Ex. |
| 28 | BM | Aluminium fluoride | 2.3 | Water | Inventive Ex. |
| 29 | BM | Magnesium chromate | 0.05 | Water | Comparative Ex. |
| 30 | AM | Zirconium phosphate | 0.4 | Water | Comparative Ex. |
| 31 | BM | Chromium acetate | 0.6 | Water | Comparative Ex. |
| 32 | BM | Gallium nitrate | 12 | Water | Inventive Ex. |
| 33 | VM | Chromium sulfate | 13 | Water | Inventive Ex. |
| 34 | VM | Aluminium chromate | 36 | Water | Inventive Ex. |
| 35 | AM | Titanium nitrate | 40 | Water | Inventive Ex. |
| 36 | AM | Aluminium phosphate | 46 | Water | Inventive Ex. |
| 37 | BM | Sodium acetate | 43 | Water | Inventive Ex. |
| 38 | BM | Aluminium chromate | 49 | Water | Inventive Ex. |
| 39 | AM | Gallium phosphate | 48 | Water | Inventive Ex. |
| 40 | BM | Zirconium sulfate | 0.3 | Water | Comparative Ex. |
| 41 | BM | Chromium nitrate | 0.2 | Water | Comparative Ex. |
| 42 | AM | Aluminium fluoride | 0.3 | Water | Comparative Ex. |

(*1): The additive amount of solute is expressed as parts by mass with respect to 100 parts by mass of water.

TABLE 3

| No | Properties of soft magnetic flaky powder | | | | | | |
|---|---|---|---|---|---|---|---|
| | Thickness of coating layer (nm) | Average particle diameter $D_{50}$ (μm) | Tap density TD ($Mg/m^3$) | D50/TD | Aspect ratio of powder | Thickness of powder (μm) | Coercive force in longitudinal direction (A/m) |
| 1 | 3 | 48 | 1.6 | 30 | 3 | 20 | 220 |
| 2 | 5 | 35 | 1.3 | 28 | 4 | 8 | 200 |
| 3 | 8 | 34 | 1.2 | 29 | 5 | 10 | 200 |
| 4 | 23 | 35 | 0.9 | 39 | 8 | 6 | 150 |
| 5 | 80 | 36 | 0.6 | 60 | 16 | 2 | 120 |
| 6 | 135 | 33 | 0.5 | 68 | 28 | 0.5 | 100 |
| 7 | 160 | 53 | 1.7 | 32 | 2 | 19 | 160 |
| 8 | 130 | 40 | 1.4 | 29 | 4 | 6 | 150 |
| 9 | 50 | 39 | 1.3 | 30 | 8 | 5 | 130 |
| 10 | 30 | 40 | 0.4 | 100 | 9 | 3 | 120 |
| 11 | 10 | 31 | 0.7 | 47 | 17 | 2 | 150 |
| 12 | 7 | 57 | 0.7 | 80 | 29 | 1 | 200 |
| 13 | 9 | 56 | 1.6 | 36 | 3 | 12 | 250 |

TABLE 3-continued

| | | | | | | | |
|---|---|---|---|---|---|---|---|
| 14 | 8 | 34 | 1.1 | 30 | 5 | 6 | 230 |
| 15 | 150 | 52 | 1.2 | 45 | 9 | 8 | 195 |
| 16 | 200 | 30 | 0.7 | 45 | 10 | 2 | 208 |
| 17 | 30 | 35 | 1.0 | 36 | 18 | 2 | 120 |
| 18 | 10 | 47 | 0.9 | 54 | 22 | 1 | 100 |
| 19 | 10 | 41 | 1.1 | 39 | 18 | 5 | 350 |
| 20 | 30 | 45 | 1.1 | 40 | 19 | 8 | 300 |
| 21 | 240 | 39 | 1.5 | 26 | 28 | 3 | 400 |
| 22 | 15 | 43 | 0.8 | 54 | 10 | 3 | 300 |
| 23 | 80 | 51 | 0.9 | 54 | 16 | 2 | 250 |
| 24 | 60 | 42 | 0.7 | 60 | 30 | 1 | 200 |

| | Properties of magnetic sheet | | | | |
|---|---|---|---|---|---|
| No | Real part μ' of complex permeability | Index value of electrical resistance (Ω/m) | Z value | Corrosion resistance | Remarks |
| 1 | 65 | 1 | 22 | C | Comparative Ex. |
| 2 | 90 | 1 | 18 | C | Comparative Ex. |
| 3 | 70 | 1 | 8.8 | C | Comparative Ex. |
| 4 | 50 | 6 | 6.5 | B | Inventive Ex. |
| 5 | 70 | 6 | 5.3 | A | Inventive Ex. |
| 6 | 50 | 10 | 3.7 | A | Inventive Ex. |
| 7 | 30 | 11 | 1.4 | A | Inventive Ex. |
| 8 | 100 | 11 | 8.5 | A | Inventive Ex. |
| 9 | 140 | 6 | 17 | A | Inventive Ex. |
| 10 | 145 | 7 | 19 | B | Inventive Ex. |
| 11 | 150 | 8 | 15 | B | Inventive Ex. |
| 12 | 70 | 1 | 24 | C | Comparative Ex. |
| 13 | 60 | 2 | 36 | C | Comparative Ex. |
| 14 | 80 | 1 | 23 | C | Comparative Ex. |
| 15 | 70 | 12 | 5.6 | A | Inventive Ex. |
| 16 | 30 | 13 | 2.0 | A | Inventive Ex. |
| 17 | 260 | 6 | 52 | A | Inventive Ex. |
| 18 | 197 | 10 | 197 | B | Inventive Ex. |
| 19 | 30 | 1 | 2.0 | B | Inventive Ex. |
| 20 | 30 | 2 | 1.5 | B | Inventive Ex. |
| 21 | 30 | 3 | 0.19 | A | Inventive Ex. |
| 22 | 50 | 4 | 13 | B | Inventive Ex. |
| 23 | 40 | 6 | 3.0 | A | Inventive Ex. |
| 24 | 30 | 6 | 2.0 | A | Inventive Ex. |

TABLE 4

| | Properties of soft magnetic flaky powder | | | | | | |
|---|---|---|---|---|---|---|---|
| No | Thickness of coating layer (nm) | Average particle diameter $D_{50}$ (μm) | Tap density TD ($Mg/m^3$) | D50/TD | Aspect ratio of powder | Thickness of powder (μm) | Coercive Force in longitudinal direction (A/m) |
| 25 | 210 | 36 | 0.6 | 63 | 19 | 2 | 250 |
| 26 | 10 | 34 | 0.6 | 60 | 19 | 2 | 230 |
| 27 | 35 | 36 | 1.0 | 36 | 22 | 2 | 175 |
| 28 | 20 | 35 | 0.9 | 40 | 36 | 3 | 170 |
| 29 | 0.15 | 25 | 1.0 | 25 | 18 | 2 | 250 |
| 30 | 3 | 44 | 1.5 | 29 | 20 | 1 | 300 |
| 31 | 5 | 43 | 1.7 | 26 | 30 | 1 | 1100 |
| 32 | 70 | 40 | 1.3 | 32 | 36 | 1 | 1200 |
| 33 | 80 | 48 | 1.2 | 39 | 28 | 3 | 1450 |
| 34 | 180 | 43 | 0.9 | 48 | 40 | 3 | 1400 |
| 35 | 200 | 43 | 1.2 | 37 | 38 | 1 | 1600 |
| 36 | 300 | 49 | 0.9 | 55 | 35 | 0.5 | 1650 |
| 37 | 280 | 46 | 0.7 | 64 | 36 | 2 | 480 |
| 38 | 400 | 56 | 1.2 | 48 | 30 | 3 | 400 |
| 39 | 500 | 54 | 1.0 | 56 | 35 | 4 | 510 |
| 40 | 3 | 56 | 1.2 | 48 | 33 | 2 | 400 |
| 41 | 2 | 59 | 2.0 | 29 | 34 | 2 | 450 |
| 42 | 2 | 20 | 1.0 | 20 | 33 | 1 | 400 |

TABLE 4-continued

| No | Properties of magnetic sheet | | | | |
|---|---|---|---|---|---|
| | Real part μ' of complex permeability | Index value of electrical resistance (Ω/m) | Z value | Corrosion resistance | Remarks |
| 25 | 20 | 9 | 2.1 | A | Inventive Ex. |
| 26 | 70 | 3 | 21 | B | Inventive Ex. |
| 27 | 70 | 6 | 12 | A | Inventive Ex. |
| 28 | 50 | 6 | 15 | A | Inventive Ex. |
| 29 | 40 | 1 | 267 | C | Comparative Ex. |
| 30 | 30 | 0 | — | C | Comparative Ex. |
| 31 | 80 | 1 | 16 | C | Comparative Ex. |
| 32 | 35 | 6 | 3.0 | A | Inventive Ex. |
| 33 | 40 | 6 | 3.0 | A | Inventive Ex. |
| 34 | 40 | 10 | 2.2 | A | Inventive Ex. |
| 35 | 20 | 12 | 1.2 | A | Inventive Ex. |
| 36 | 20 | 13 | 0.9 | A | Inventive Ex. |
| 37 | 15 | 13 | 0.7 | A | Inventive Ex. |
| 38 | 10 | 13 | 0.3 | A | Inventive Ex. |
| 39 | 10 | 13 | 0.3 | A | Inventive Ex. |
| 40 | 80 | 0 | — | C | Comparative Ex. |
| 41 | 65 | 0 | — | C | Comparative Ex. |
| 42 | 40 | 0 | — | C | Comparative Ex. |

Of Nos. 1 to 42 in Tables 1 to 4, Nos. 4 to 11, 15 to 28, and 32 to 39 are inventive examples, whereas Nos. 1 to 3, 12 to 14, 29 to 31, and 40 to 41 are comparative examples.

In Comparative examples Nos. 1 to 3, 12 to 14, 29 to 31, and 40 to 41, the thickness of the coating layer is less than 10 nm, and thus the electrical resistance of the magnetic sheet is low (index value of electrical resistance: less than 3), and the corrosion resistance is poor (evaluation of corrosion resistance: C). When the thickness of the coating layer is less than 10 nm, the coercive force in the longitudinal direction of the soft magnetic flaky particles tends to be high (the coercive force in the longitudinal direction: more than 200 A/m), and the real part μ' of the permeability in the high frequency region of the magnetic sheet tends to decrease (the real part μ' of the complex permeability p: less than 100).

In Inventive examples Nos. 4 to 11, 15 to 28, and 32 to 39, the thickness of the coating layer is 10 nm or more, and thus the electrical resistance of the magnetic sheet is high (index value of the electrical resistance: 6 or more) and the corrosion resistance is good (corrosion evaluation: A or B). However, when the thickness of the coating layer exceeds 200 nm, the coercive force of the soft magnetic flaky particles in the longitudinal direction tends to be high (the coercive force in the longitudinal direction: more than 400 A/m). In addition, the proportion occupied by the Fe-based alloy flaky particles in the magnetic sheet is small, and thus the real part μ' of the permeability in the high frequency region of the magnetic sheet tends to decrease (the real part μ' of the complex permeability p: less than 20).

The invention claimed is:

1. A soft magnetic flaky powder, comprising a plurality of soft magnetic flaky particles, wherein:

each of the plurality of soft magnetic flaky particles comprises an Fe-based alloy flaky particle and a coating layer formed on a surface of the Fe-based alloy flaky particle;

the coating layer comprises one or two or more components selected from the group consisting of chromic acid and a hydrate thereof, a metal salt of acetic acid and a hydrate thereof, and a metal salt of an inorganic acid and a hydrate thereof;

the inorganic acid is selected from the group consisting of sulfuric acid, nitric acid, chromic acid, phosphoric acid, and hydrofluoric acid;

the metal salts of the acetic acid and the inorganic acid are selected from the group consisting of a Na salt, a Ti salt, a Cr salt, a Ni salt, and a Ga salt;

the coating layer has a thickness of 10 nm or more; and a ratio of an average particle diameter $D_{50}$ to a tap density TD is $30\times10^{-6}\cdot m^4/Mg$ to $100\times10^{-6}\cdot m^4/Mg$ ($10^{-6}\cdot m^4/Mg$).

2. The soft magnetic flaky powder according to claim 1, wherein the thickness of the coating layer is −10 nm or more and 200 nm or less.

3. The soft magnetic flaky powder according to claim 1, wherein each of the plurality of soft magnetic flaky particles has an aspect ratio of 10 to 40.

4. The soft magnetic flaky powder according to claim 1, wherein each of the plurality of soft magnetic flaky particles has a thickness of 0.5 to 5 μm.

5. The soft magnetic flaky powder according to claim 1, wherein the average particle diameter $D_{50}$ is 20 to 60 μm.

6. The soft magnetic flaky powder according to claim 1, wherein the tap density TD is 0.6 to 1.5 $Mg/m^3$.

7. The soft magnetic flaky powder according to claim 1, wherein a coercive force Hc is 176 A/m or less.

8. A magnetic sheet, comprising the soft magnetic flaky powder according to claim 1.

9. The magnetic sheet according to claim 8, wherein a real part μ' of permeability is 30 to 260.

10. The magnetic sheet according to claim 8, wherein a surface resistance is $1\times10^7$ to $1\times10^{15}$ Ω·m.

11. The magnetic sheet according to claim 8, wherein a value Z is 0.2 to 200, the value Z being calculated based on Formula (1):

$$Z=(X\times\log_{10}Y)/D \quad (1)$$

wherein X is a real part μ' of the permeability of the magnetic sheet, Y, in Ω·m, is a surface resistance of the magnetic sheet, and D (nm) is the thickness of the coating layer.

12. The soft magnetic flaky powder according to claim 2, wherein each of the plurality of soft magnetic flaky particles has an aspect ratio of 10 to 40.

13. The soft magnetic flaky powder according to claim 2, wherein each of the plurality of soft magnetic flaky particles has a thickness of 0.5 to 5 μm.

14. The soft magnetic flaky powder according to claim 3, wherein each of the plurality of soft magnetic flaky particles has a thickness of 0.5 to 5 μm.

15. The soft magnetic flaky powder according to claim 12, wherein each of the plurality of soft magnetic flaky particles has a thickness of 0.5 to 5 μm.

16. The soft magnetic flaky powder according to claim 2, wherein the average particle diameter $D_{50}$ of 20 to 60 μm.

17. The soft magnetic flaky powder according to claim 3, wherein the average particle diameter $D_{50}$ of 20 to 60 μm.

18. The soft magnetic flaky powder according to claim 4, wherein the average particle diameter $D_{50}$ of 20 to 60 μm.

19. The soft magnetic flaky powder according to claim 12, wherein the average particle diameter $D_{50}$ of 20 to 60 μm.

* * * * *